US006000866A

United States Patent [19]

Funaki et al.

[11] Patent Number: 6,000,866

[45] **Date of Patent: *Dec. 14, 1999**

[54] PRINTER WITH SHEET CURL STRAIGHTENING DEVICE

[75] Inventors: Hitoshi Funaki; Hideki Yorozu; Yuusai Ishitobi; Mitsuo Tsushima, all of Iwate-ken, Japan

[73] Assignee: Alps Electric Co., Ltd.

[ * ] Notice: This patent issued on a continued prosecution application filed under 37 CFR 1.53(d), and is subject to the twenty year patent term provisions of 35 U.S.C. 154(a)(2).

[21] Appl. No.: 09/026,029

[22] Filed: Feb. 19, 1998

[30] Foreign Application Priority Data

Feb. 19, 1997 [JP] Japan ..... 9-051041

[51] Int. Cl.[6] ..... B65H 29/70

[52] U.S. Cl. ..... 400/120.01; 400/613.3; 400/320; 271/188; 271/209

[58] Field of Search ..... 101/232; 400/613.3, 400/619, 323, 647, 636, 628, 120.01, 320; 271/188, 209

[56] References Cited

U.S. PATENT DOCUMENTS 5,534,902 7/1996 Hoesly ..... 347/104

5,672,018 9/1997 Yamamoto et al. ..... 400/613.3

FOREIGN PATENT DOCUMENTS

| | | |
|---|---|---|
| 0 496 375 A2 | 7/1992 | European Pat. Off. . |
| 0 616 264 A1 | 9/1994 | European Pat. Off. . |
| 3-61260 | 3/1991 | Japan . |
| 3-143864 | 6/1991 | Japan . |
| 07277566 | 10/1995 | Japan . |
| 08012161 | 1/1996 | Japan . |
| 08197800 | 8/1996 | Japan . |

*Primary Examiner*—Edgar Burr
*Assistant Examiner*—Dave Ghatt
*Attorney, Agent, or Firm*—Brinks Hofer Gilson & Lione

[57] ABSTRACT

A printer including, from an upstream side to a downstream side in a sheet feeding direction, a sheet feed mechanism, a carriage, a curl straightening device, and a sheet discharge mechanism. A curl straightening head of the curl straightening device is resilient. The carriage and the curl straightening device are driven by a same drive source. The printer is a cheap printer which can allow reliable straightening of curled recorded sheet, even when sheets of different thicknesses are used, and which can reliably discharge the sheet out the printer.

3 Claims, 5 Drawing Sheets

PRINTER WITH SHEET CURL STRAIGHTENING DEVICE

BACKGROUND OF THE INVENTION

1. Field of the Invention

The present invention relates to a printer provided with a curl straightening device capable of straightening a curled recorded sheet.

2. Description of the Related Art

A conventional printer will be described, taking as an example the thermal transfer printer proposed by the applicant in Japanese Unexamined Patent Publication No. 8-174947.

The conventional thermal transfer printer is described with reference to FIGS. 5 and 6. FIG. 5 is a sectional view of the main portion of the conventional printer, while FIG. 6 is a schematic view illustrating the operation of a curl straightening device of the conventional printer. A print platen 20, having a print surface 20*a*, is disposed in the body (not shown) of a thermal transfer printer S of FIG. 5. A thermal head 21, which can freely come into contact with and separate from the print platen 20, is disposed upwardly of the print platen 20 so as to oppose it. An ink ribbon (not shown) and a sheet 2 are supplied between the print platen 20 and the thermal head 21, with the sheet 2 being transported in the direction of arrow A.

The thermal head 21 is disposed at a carriage 22 that can freely reciprocate along the print platen 20 by means of a drive source (now shown). The carriage 22 carries a ribbon cassette provided with an ink ribbon (not shown).

A sheet feed mechanism, including a sheet feed roller 23 and an auxiliary roller 24 rotatably in contact with the upper outer peripheral surface of the sheet feed roller 23, is disposed at the upstream side in the sheet 2 feeding direction, that is at the right side of the print platen 20 of FIG. 5. The sheet 2 is nipped between the sheet feed roller 23 and the auxiliary roller 24, which rotate to transport the sheet 2 in the direction of arrow A, that is along the print surface 20*a* of the print platen 20. At the downstream side or left side of the print platen 20 of FIG. 5, recorded sheet 2 is nipped between a sheet discharge guide 25 and a sheet discharge roller 26 (which make up a sheet discharge mechanism). Then, it is discharged to a downstream side curl straightening device 27 as a result of the rotation of the sheet discharge roller 26.

In the curl straightening device 27, a curl straightening head 28, having a base 28*a* as shown in FIG. 6, has a guide roller 28*b* below the base 28*a* and a roller 28*c* at the upper end of the base 28*a*, so that the head 28, supported by a guide shaft 29, can freely reciprocate along the guide shaft 29. Supporting frames 30 are integrally formed at both ends of the guide shaft 29 in order to support the guide shaft 29, with a cam surface 30*a* being formed at the front side of the supporting frames in the longitudinal direction thereof.

A wide-width protrusion 30*b* is formed at the center portion of the cam surface 30*a* in the longitudinal direction thereof. Recesses 30*c*, being lower in height than the protrusion 30*b*, are formed on the left and right ends of the protrusion 30*b*. Inclined surfaces 30*d* are formed continuously between their respective recesses 30*c* and the protrusion 30*b* so as to connect two different levels.

When the sheet 2, which has been subjected to recording, is waiting to be supplied to the curl straightening device 27, the curl straightening head 28 is either at the left end side or the right end side of the guide shaft 29, and the guide roller 28*b* is in contact with either one of the recesses 30*c* in the cam surface 30*a*. The curl straightening head 28 rotates in the direction of arrow Y of FIG. 5, with the guide shaft 29 as rotational center, and the roller 28*c* separates from the lower surface of the supporting platen 31, forming a gap between the roller 28*c* and the supporting platen 31.

When the sheet curl straightening device 27 is in the aforementioned waiting state, the sheet 2, which is curled as a result of printing using a thermal transfer printer or the like, is set in the gap between the supporting platen 31 and the curl straightening head 28, as a result of being transported from the sheet feed mechanism, such that the print surface opposes the supporting platen 31.

A motor 32, being a drive source for the curl straightening head 28 and being different from the drive source (not shown) for the carriage 22, is mounted to the lower surface of the left end of supporting frame 30. Driving the motor 32 causes a pulley 33 to rotate, and a rope 34 wound upon the pulley 33 to move. The tension in the rope 34 causes the curl straightening head, mounted to the rope 34, to start moving, for example, from the left end side to the right end side.

Movement of the curl straightening head 28 causes the guide roller 28*b* to move, for example, up the left inclined surface 30*d* from the left recess 30*c* to the protrusion 30*b* of the cam surface 30*a*. This causes an end of the curl straightening head 28 to rotate in the direction of arrow X with the guide shaft 29 as rotational center, whereby the roller 28*c* is press-contacted with a predetermined press-contact force against the sheet 2 set at the lower surface of the supporting platen 31.

Then, the roller 28*c* of the curl straightening head 28 moves in the direction of arrow B as it strokes the back side, or the side opposite the print surface 2*a*, of the sheet 2 to eliminate the curl of the sheet 2.

When the curl straightening head 28 reaches the right end of the guide shaft 29, the guide roller 28*b* of the curl straightening head 28 rolls down along the right inclined surface 30*b* of the cam surface 30*a* and arrives at the right recess 30*c*. When the guide roller 28*b* is at the recess 30*c*, the curl straightening head 28 rotates in the direction of arrow Y with the guide shaft 29 as rotational center, whereby the roller 28*c* separates from the supporting platen 31, and thus set in a waiting state.

When a predetermined amount of the sheet 2, curled after printing, is transported in the direction of arrow A to the curl straightening device 27 in the aforementioned waiting state, the curl straightening head 28 moves to the left from the right end along the guide shaft 29, causing the roller 28*c* to press-contact the supporting platen 31 again and move towards the left while stroking the sheet 2 supported by the supporting platen 31. The above-described operations are repeated in order to straighten the curled sheet 2 by stroking the back side thereof by the roller 28*c*.

Such a conventional printer S is very costly, since separate drive sources must be provided for the moving the curl straightening head 28 and the carriage 22. In other words, the conventional printer S requires a motor 32 as a drive source for reciprocating the curl straightening head 28 of the curl straightening device 27 and another drive source (not shown) for moving the carriage 22 having mounted thereto the thermal head 21 serving as a recording head for the printer S.

In addition, the sheet feed mechanism including the sheet feed roller 23 or the like, the carriage 22, and the sheet discharge mechanism including the sheet discharge roller or the like, and the curl straightening device 27 are disposed successively from the upstream side to the downstream side in the sheet feeding direction. Therefore, when an attempt is made to discharge the sheet S out the printer S through the sheet discharge guide 25 and the sheet discharge roller 26 of the sheet discharge mechanism, the downstream curl straightening device 27 blocks the discharge of the sheet, preventing reliable sheet discharge.

When the sheet discharge mechanism does not successfully discharge the sheet 2 out the printer S, the sheet 2 must be taken out from the curl straightening device 27 by pushing the trailing end of the sheet 2 with some kind of member or by pulling the front end of the sheet 2 discharged from the curl straightening device 27, thus making it troublesome to handle the sheet 2.

The curl straightening head 28 rotates in the direction of arrow X or arrow Y of FIG. 5 as a result of the movement of the lower guide roller 28*b* from either one of the recesses 30*c* to the protrusion 30*b*, or from the protrusion 30*b* to either one of the recesses 30*c*. Thus, variations in parallelism between the surface of the supporting platen 31 and the roller 28*c* occur as a result of, for example, accumulation of component part errors, such as those of the base 28*a* of the curl straightening head 28, the guide roller 28*b*, or the roller 28*c*. This prevents the roller 28*c* from rolling parallel to the supporting platen 31 while stroking the sheet 2, so that the curled sheet 2 cannot be properly straightened.

SUMMARY OF THE INVENTION

The present invention is directed to a printer comprising, from the upstream side to the downstream side in the sheet feeding direction, a sheet feed mechanism, a carriage, a curl straightening device, and a sheet discharge mechanism.

It is an object of the present invention to provide a printer whose sheet discharge mechanism can reliably discharge a sheet, which has been subjected to recording, out the printer in order to facilitate sheet handling.

In addition, the present invention is directed to a printer in which the same drive source is used for driving the carriage and the curl straightening device.

It is another object of the present invention to provide a low-cost printer which does not use an expensive drive source.

Further, the present invention is directed to a printer wherein the curl straightening drive comprises a supporting platen for supporting a recorded sheet, and a curl straightening head for straightening a curled recorded sheet. The curl straightening head comprises a base with a resilient member provided thereat, and a holder supported by the resilient member so as to be rotatable vertically.

It is a further object of the present invention to provide a printer which can reliably straighten sheets of different thicknesses.

Still further, the present invention is directed to a printer comprising a selecting means. The curl straightening head of the curl straightening device moves vertically in order to either resiliently press against or separate from the supporting platen. The selecting means is used to select either one of resiliently pressing the head against and separating it from the supporting platen by controlling the amount of movement of the carriage.

It is still a further object of the present invention to provide a printer which is capable of easily clearing the curl straightening function setting, when a sheet does not need straightening.

Still further, the present invention is directed to a printer wherein the selecting means, for selecting either one of resiliently pressing the curl straightening head against the supporting platen or separating it from the supporting platen, is composed of a cam mechanism composed of a plurality of rail-shaped protrusions.

It is still a further object of the present invention to provide a printer wherein the curl straightening head moves up and down in the vertical direction, and the curl straightening head resiliently presses against the supporting platen while it is set parallel thereto with a high degree of parallelism, in order to reliably straighten the curled sheet.

DESCRIPTION OF THE PREFERRED EMBODIMENTS

Figure 1:
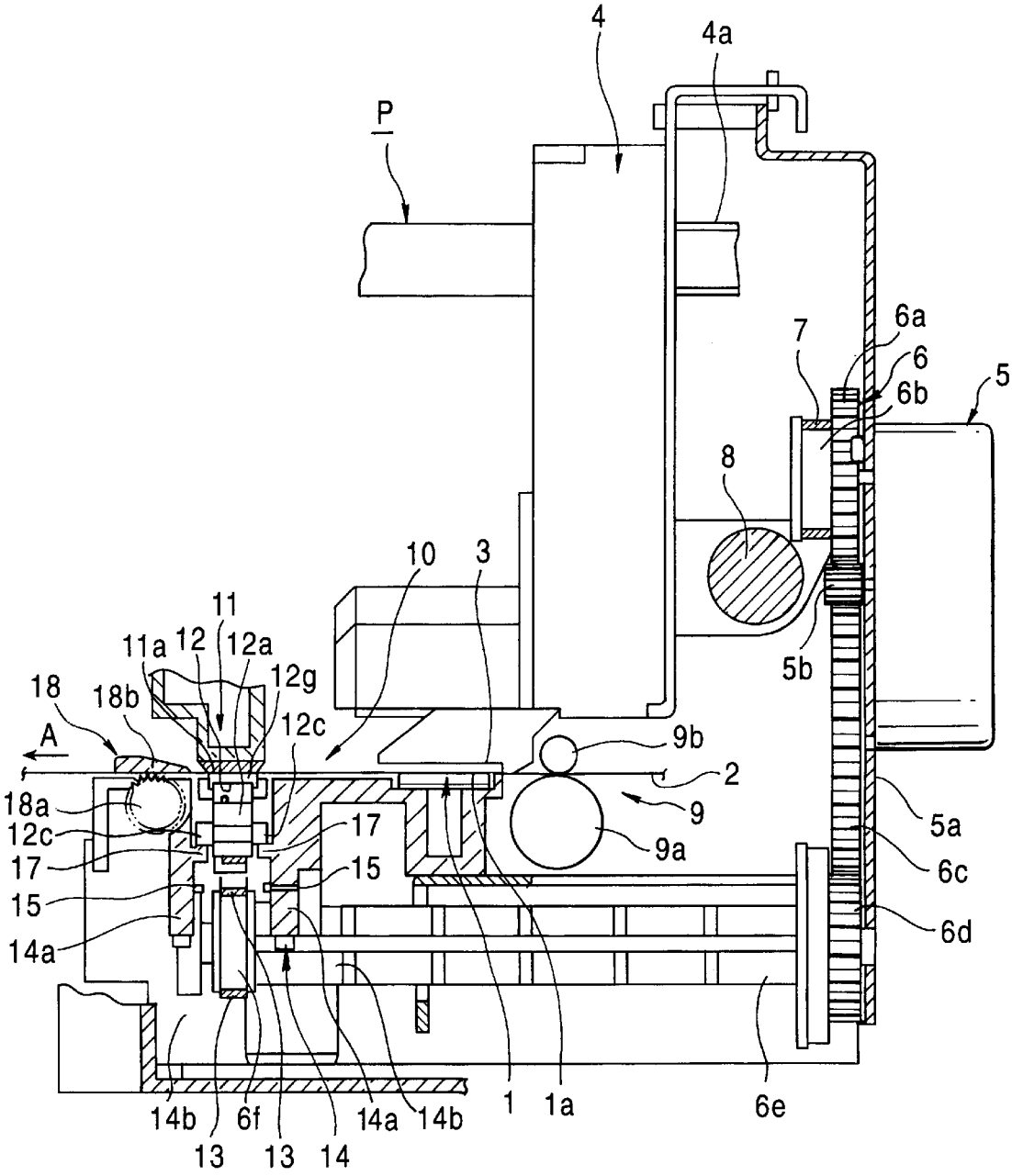
FIG. 1 is a sectional view of the main structure of a printer of the present invention.

A description will now be given of a printer of the present invention, taking as an example the thermal transfer printer shown in FIGS. 1 to 4. As shown in FIG. 1, a tabular print platen 1, having a print surface 1*a*, is formed in the body (not shown) of a printer P of the present invention. The print surface 1*a* is disposed substantially horizontally. A sheet 2 is placed so as to be supplied from the right of FIG. 1 to the print surface 1*a*.

Above the side of the print platen 1 with the sheet 2 placed thereon, a recording head 3, being a thermal head with a plurality of heating elements (not shown) arranged along the head 3, is mounted to the lower portion of a carriage 4 such that it can move into contact with and separate from the print platen 1.

An ink ribbon is supplied between the print platen 1 and the recording head 3 from a ribbon cassette (not shown) mounted to the carriage 4, with the sheet 2 being supplied below the ink ribbon from the upstream side.

A stepping motor 5 is mounted to a chassis 5*a* with a screw or the like, and serves as a drive source for driving, for example, a belt 7 (described later) which is a carriage drive means for reciprocating the carriage in a recording direction along the longitudinal direction of the print platen 1. A pinion gear 5*b* is mounted to an end of a rotary shaft of the stepping motor 5. A gear group 6 engages the pinion gear 5*b* in order to transmit the rotational motion of the stepping motor 5 to the carriage 4.

The gear group 6, made of synthetic resin or the like, comprises a drive gear 6*a*, a belt drive gear 6*b*, an intermediate gear 6*c*, a drive gear 6*d*, and a pinion gear 6*f*.

The gear group 6 is brought into engagement with the pinion gear 5*b* by engaging the drive gear 6*a* with the top of the pinion gear 5*b* and engaging the intermediate gear 6*c* with the bottom of the pinion gear 5*b*.

The belt drive gear 6*b*, having a smaller outside diameter than that of the drive gear 6*a*, is integrally formed with the drive gear 6*a*, such that the center of rotation of the belt drive gear 6*b* coincides with the center of rotation of the drive gear 6*a*.

The drive gear 6*d* meshes the lower portion of the intermediate gear 6*c*. A rod-like, long-and-narrow coupling shaft 6*e* is formed integrally with the drive gear 6*d*, such that its center of rotation coincides with that of the drive gear 6*d*. It extends downstream in the sheet 2 feeding direction, with the pinion 6*f* formed at an end of the coupling shaft 6*e*.

The belt 7, whose inside surface is formed into the shape of a rack, meshes the belt drive gear 6*b* formed integrally with the drive gear 6*a*. When a carriage coupling portion 4*a* is mounted to the belt 7 by a mounting member (not shown), and the carriage 4 is supported by a guide shaft 8, rotation of the stepping motor 5, serving as the drive source, causes rotation of the drive gear 6*a*, being a carriage drive means, and the belt drive gear 6*b*. When the belt 7 is driven as a result of this rotation, the carriage 4 reciprocates in the recording direction, corresponding to the longitudinal direction of the print platen 1, through the carriage coupling portion 4*a*.

The carriage 4 carries a ribbon cassette containing an ink ribbon (not shown). When the recording head 3 moves downward so that it is in a printing state, the ink ribbon is drawn out from the ribbon cassette to be supplied between the recording head 3 and the print platen 1.

At the upstream side in the sheet 2 feeding direction and at the right side of the print platen 1 of FIG. 1, a sheet feed mechanism 9 is disposed for feeding the sheet 2 from the upstream side to the downstream side. The sheet feed mechanism 9 is composed of a sheet feed roller 9*a* and an auxiliary roller 9*b*, with the auxiliary roller 9*b* contacting the upper outer peripheral portion of the sheet feed roller 9*a* so as to be rotatable. The sheet 2 is nipped between the sheet feed roller 9*a* and the auxiliary roller 9*b* that rotate in the direction of arrow A in order to feed it from the upstream side to the downstream side.

A curl straightening device 10 is disposed at the downstream side of the print platen 1 and the carriage 4 in order to straighten any sheet 2, curled by, for example, the heat of the recording head 3.

A supporting platen 11 is disposed at the curl straightening device 10 and at the upstream side of the sheet 2 to be transported downstream in order to support the sheet 2. The side of the platen 11 that comes into contact with the print surface of the sheet 2 is provided with a friction member 11*a*, composed of, for example, a plate-like rubber.

Accordingly, the construction of the printer P of the present invention includes, from the upstream side to the downstream side in the feeding direction of the sheets 2, the sheet feed mechanism 9, followed by the carriage 4, followed by the curl straightening device 10, and followed by a sheet-discharge mechanism 18.

A curl straightening head 12 is disposed below the supporting platen 11, and resiliently presses against the sheet 2, curled by, for example, heat from the recording head 3, from the back side, or from the side opposite the recording surface, of the curled sheet 2 in order to straighten it.

Figure 2:
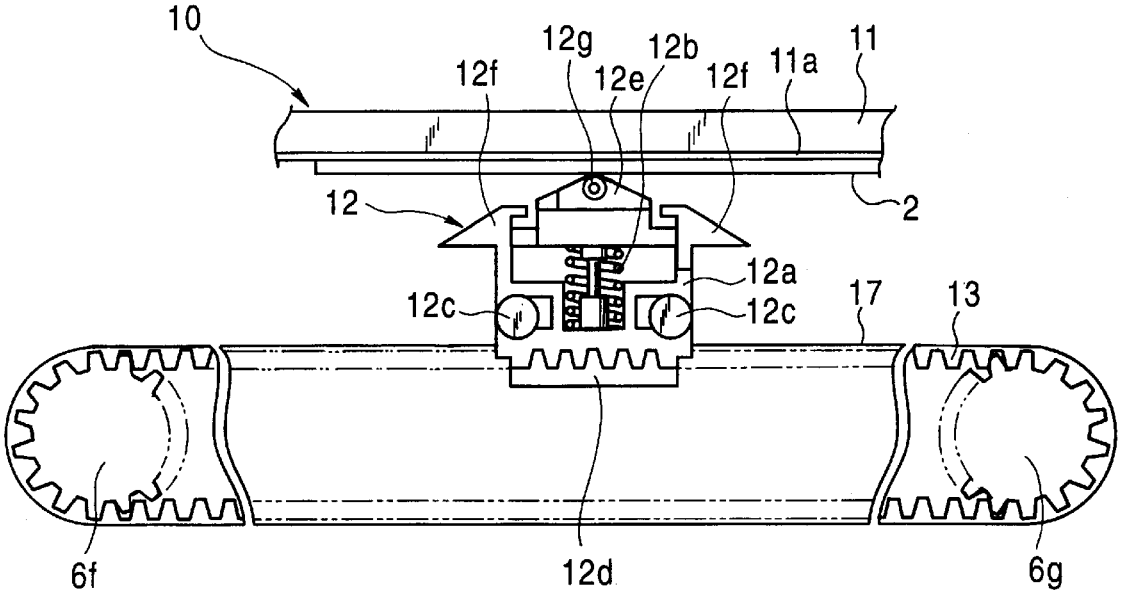
FIG. 2 is a schematic view of a curl straightening device of the printer of the present invention.
Figure 3:
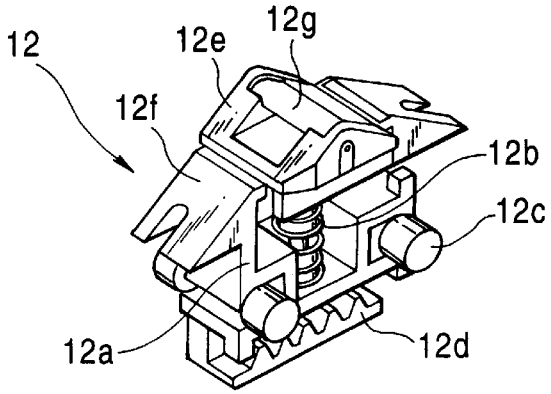
FIG. 3 is a perspective view of a curl straightening device of the printer of the present invention.
Figure 4:
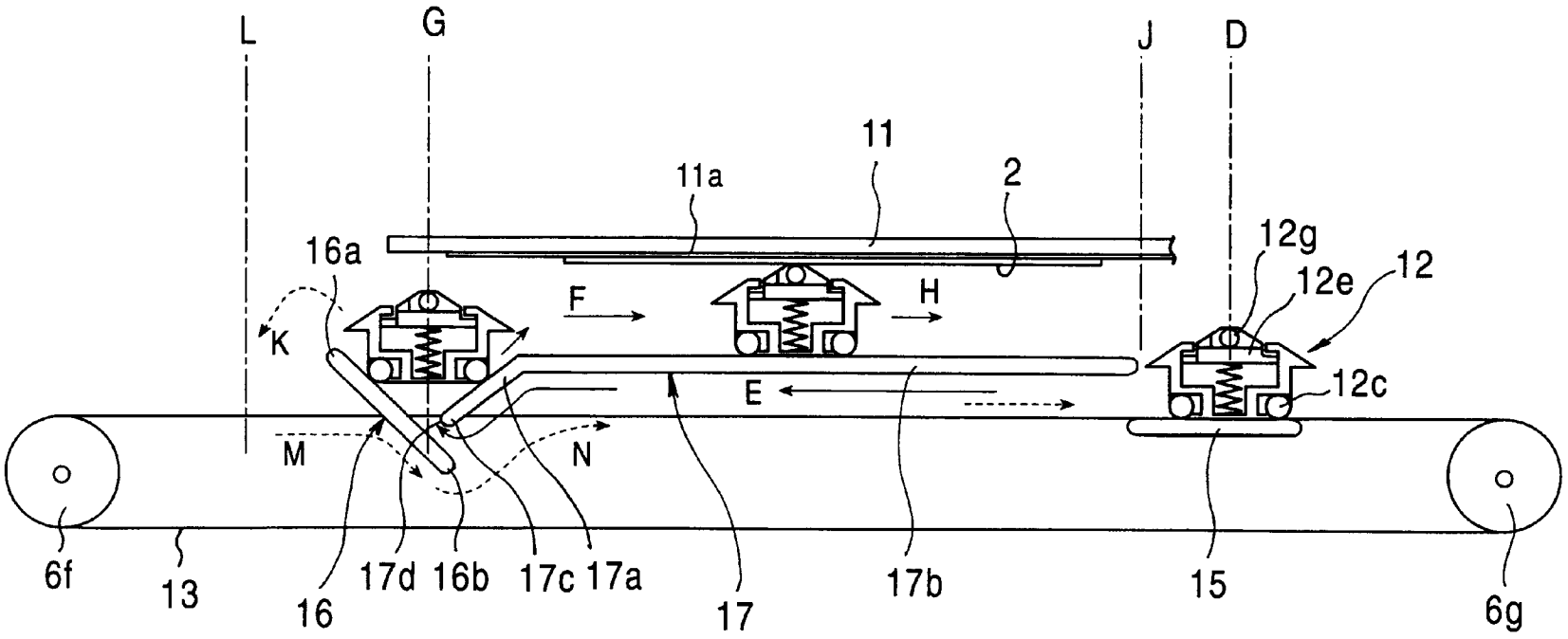
FIG. 4 is a schematic view illustrating the operation of the curl straightening head of the printer of the present invention.
Figure 5:
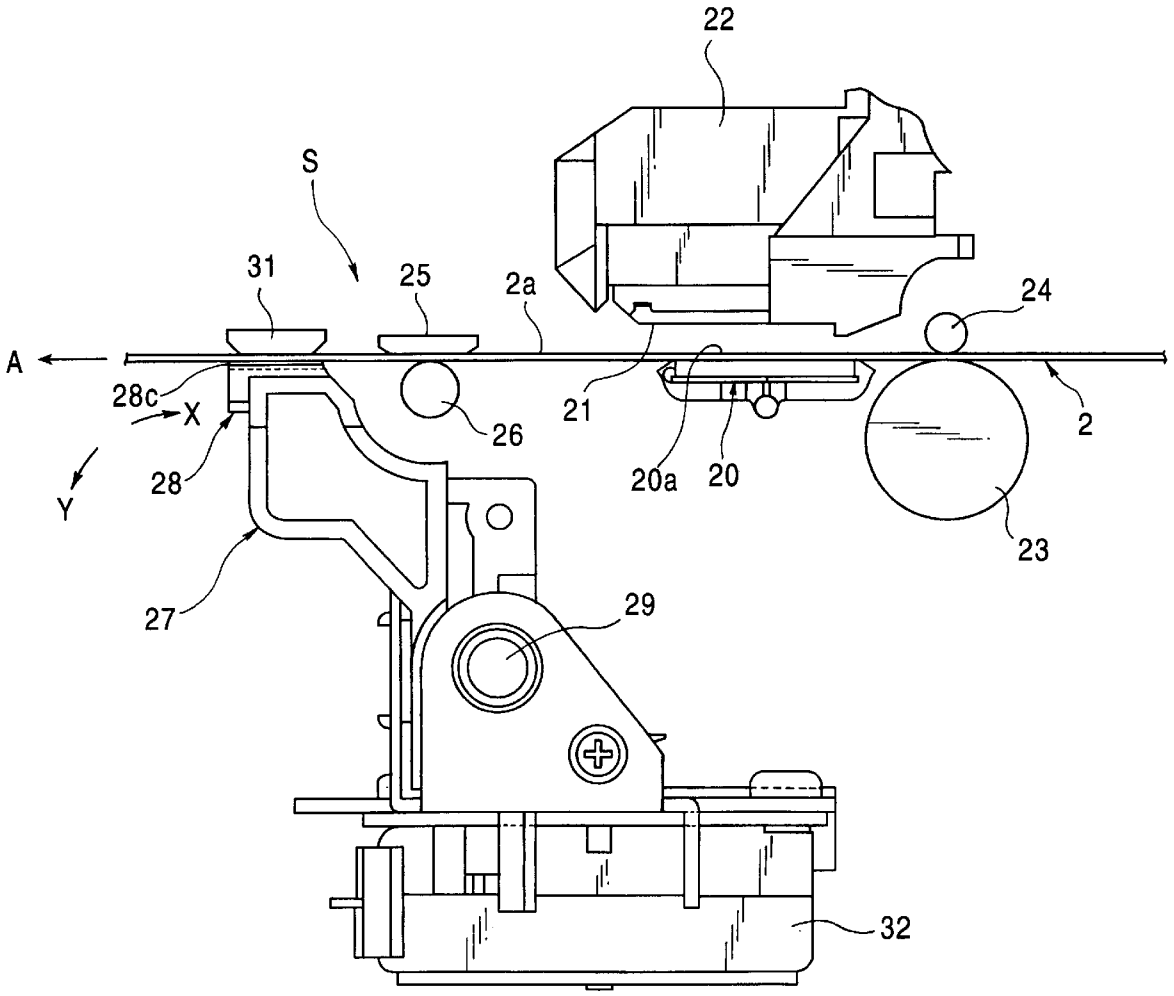
FIG. 5 PRIOR ART
FIG. 5 is a sectional view of the main portion of a conventional printer.
Figure 6:
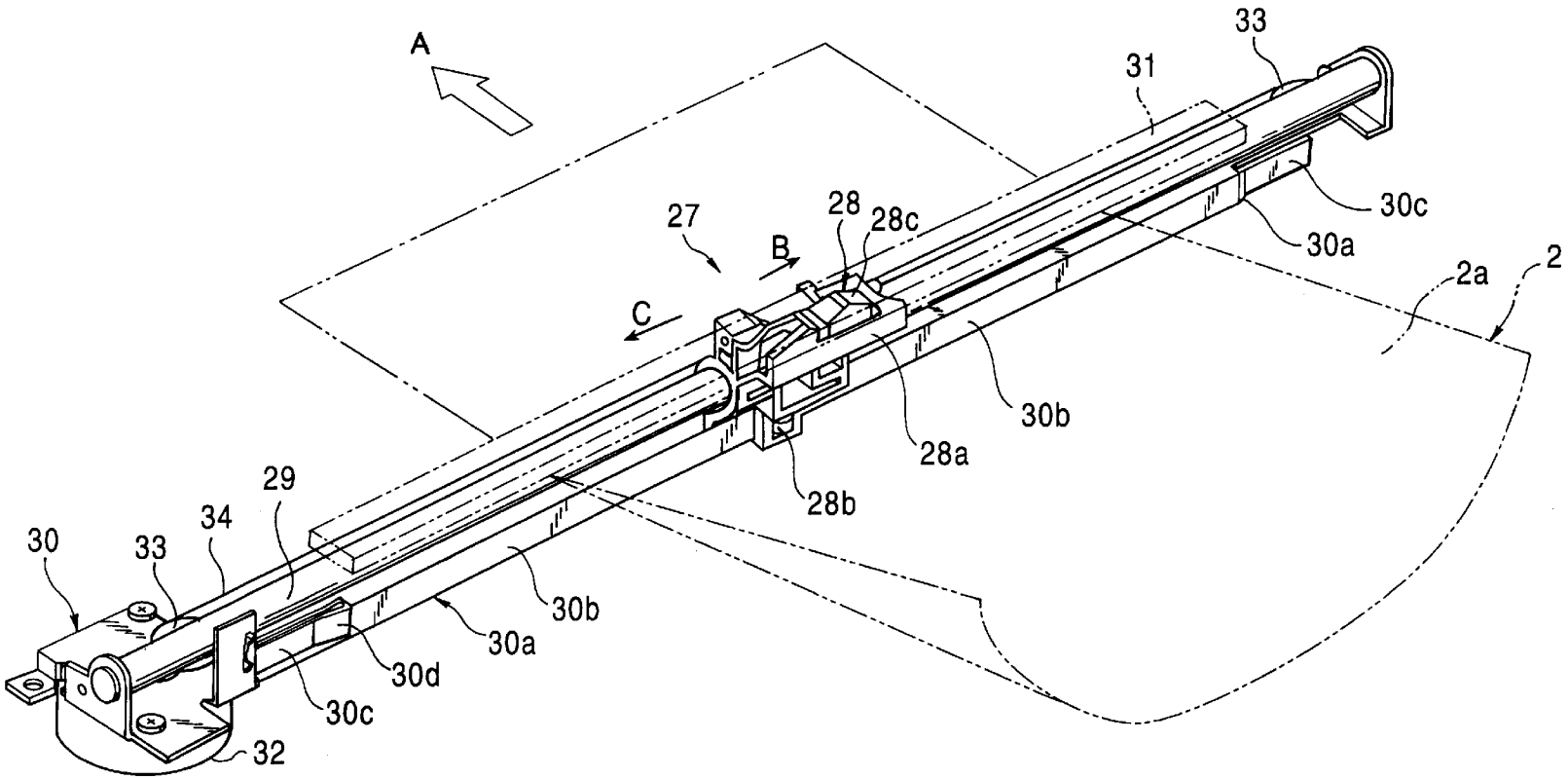
FIG. 6 PRIOR ART
FIG. 6 is a schematic view illustrating the operation of the curl straightening device of the conventional printer.

As shown in FIGS. 2 to 4, the curl straightening head 12 includes a base 12*a*, made of synthetic resin or the like, with a rod-like protrusion formed at the center of the inside lower surface of the base 12*a*, and a coil spring, corresponding to a resilient member 12*b*, which engages the protrusion. Two grooves are formed in the lower portion of the base 12*a* at the left and right sides thereof, each of which rotatably holds a metallic, rod-like guide roller 12*c*.

As shown in the perspective view of FIG. 3, the guide rollers 12*c* protrude from both sides of the base 12*a* by only a predetermined amount, and are supported by first to third rails (described later) which form a cam mechanism, so as to control the vertical position of the curl straightening head 12.

A holder 12*e*, made of synthetic resin or the like, is disposed in the base 12*a*, and supported by flanges 12*f* at the top portion of the base 12*a* so that it does not fall off. The holder 12*e* is resiliently supported upward by the action of the resilient member 12*b*.

A metallic roller 12*g* is rotatably axially supported at the upper end of the holder 12*e*, with both ends of the roller 12*g* being rotatably held by the holder 12*e*.

Accordingly, the printer P of the present invention is provided with a curl straightening device 10 including supporting platen 11 for supporting recorded sheet 2, and curl straightening head 12 for straightening a curled recorded sheet 2. The curl straightening head 12 has a base 12*a* having a resilient member 12*b* provided thereat, and a holder 12*e* vertically movably supported by the base 12*a*. The head 12 moves freely in the recording direction, while the holder 12*e* resiliently presses against the supporting platen 11 by the action of the resilient member 12*b*.

A belt 13, forming part of the drive means of the curl straightening device 10, is mounted at the lower portion of the base 12*a* by a securing member 12*d* in order to reciprocate the curl straightening head 12. The belt 13 is made of rubber or the like, with its inside surface formed into the shape of a rack. The curl straightening head 12 resiliently presses against or separates from the supporting platen 11, and reciprocates in the recording direction, whereby the curled sheet 2 is straightened.

The stepping motor 5, used as the drive source for driving, for example, the belt 7, being the drive means for the carriage 4, is also used as the drive source for driving the belt 13. The rotational motion of the stepping motor 5 is transmitted to the pinion gear 6*f* through the intermediate gear 6*c* and the drive gear 6*d*. When this causes rotation of the pinion gear 6*f*, the belt 13, placed over the pinion gear 6*f* and an idle gear 6*g*, is driven, causing the curl straightening head 12, mounted to the belt 13, to reciprocate.

Accordingly, in the printer P of the present invention, the stepping motor 5 is used for driving the carriage drive means as well as for driving the curl straightening device drive means, so that the same drive source is used for driving the carriage drive means and the curl straightening device drive means.

The curl straightening head 12, the belt 13, the pinion gear 6*f*, the idle gear 6*g*, etc., are disposed in a room 14*b* of a case 14 made of synthetic resin or the like, with the room 14*b* formed by two side walls 14*a*. As shown in FIG. 4, a first rail 15, a second rail 16, and a third rail 17, making up a cam mechanism, are formed at both of the side walls 14*a* of the room 14*b* so as to protrude inwardly of the room 14*b*. The first, second, and third rails 15, 16, and 17 serve as selecting means for selecting the vertical position of the curl straightening head 12. As shown in FIG. 1, the guide rollers 12*c* of the curl straightening head 12 are placed on the surface of the first rail 15, the second rail 16, and the third rail 17, such that the roller 12*g* at the end of the holder 12*e* is positioned above the surfaces of the rails 15, 16, and 17.

The first rail 15 of FIG. 4 protrudes in a straight line and horizontally at the side of the room 14*b* located towards the idle gear 6*g*. When the curl straightening head 12 is positioned on the first rail 15, an end of the holder 12*e* of the curl straightening head 12 is kept separated from the supporting platen 11, that is the curl straightening device is kept in a curl straightening off driving state.

The second rail 16 is formed at the side of the room 14*b* located towards the pinion gear 6*f*. The end 16*a* of the second rail 16 disposed towards the pinion gear 6*f* is positioned upwardly of the end 16*b* of the second rail 16 disposed at the side of the room 14*b* away from the pinion gear 6*f*. In FIG. 4, the second rail 16 is formed into a straight rail, and slopes upwards and is inclined leftwards from the vertical at a predetermined angle.

The second rail 16 is formed such that when the curl straightening head 12 moves in the direction of arrow E, the guide rollers 12*c* of the curl straightening head 12 contact the end 16*b* of the second rail 16, and the belt 13 is pulled, causing the curl straightening head 12 to move along the second rail 16 which slopes upwards and is inclined leftwards from the vertical.

The third rail 17 is a combination of an inclined rail portion 17*a*, which slopes upwards and towards the right so as to be formed substantially perpendicular to the tilted second rail 16, and a horizontal rail portion 17*b*, which extends horizontally from the inclined rail portion 17*a* having a predetermined size. The first rail 15 is formed beside one end of and below the horizontal rail 17*b* so as to extend parallel thereto.

A predetermined gap 17*d* is formed between the end 17*c* of the inclined rail 17*a* and the second rail 16 to a size allowing the two guide rollers 12*c* of the curl straightening head 12 to pass therethrough so that they do not have to be forced therethrough.

When the two guide rollers 12*c* pass through the gap 17*d*, the curl straightening head 12, which moves upwards and towards the left along the second rail 16, is positioned such that the guide roller 12*c* at the side located towards the pinion gear 6*f* is positioned on the second rail 16, and the guide roller 12*c* at the side located towards the idle gear 6*g* is positioned on the inclined rail portion 17*a* of the third rail 17.

When the pinion gear 6*f* rotates in the reverse direction, the two guide rollers 12*c* moves upwards and towards the right along the inclined rail 17*a*. When the guide rollers 12*c* reach the point of intersection of the inclined rail portion 17*a* and the horizontal rail portion 17*b*, the guide rollers 12*c* move on the horizontal rail portion 17*b* towards the right in the direction of arrow H.

When the two guide rollers 12*c* of the curl straightening head 12 are either on the first rail 15 or moving below the third rail 17, the roller 12*g* of the curl straightening head 12 is separated from the supporting platen 11 so that curl straightening head 12 is driven in a curl straightening off driving state.

On the other hand, when the two guide rollers 12*c* of the curl straightening head 12 are moving on the third rail 17, the roller 12*g*, rotatably and axially supported by an end of the holder 12*e*, resiliently presses against a frictional member 11*a* of the supporting platen 11, so that the curl straightening head 12 is driven in a curl straightening on driving state.

A sheet discharge mechanism 18 is constructed downstream from the curl straightening device 10 in order to discharge the printed sheet 2 out the printer P. The sheet discharge mechanism 18 comprises a circular sheet discharge roller 18*a* and a sheet discharge guide 18*b*. The sheet discharge roller 18*a* is disposed below the sheet 2 and is made of rubber or other materials having a large frictional resistance with respect to the sheet 2. The sheet discharge guide 18*b* is disposed above the sheet discharge roller 18*a* and is made of, for example, synthetic resin.

According to the printer P of the present invention having the above-described construction and being a thermal transfer printer in the present embodiment, desired characters or images are formed on predetermined locations of the sheet 2 in the following way. The sheet 2 is fed by the sheet feed mechanism 9, and an ink ribbon (not shown) is supported by the print surface 1*a* of the print platen 1. While the recording head 3, press-contacted against the print platen 1 through the sheet 2 and the ink ribbon, reciprocates along the print platen along with the carriage 4, the ink ribbon is supplied from the ribbon cassette (not shown), and heating elements of the recording head 3 are selectively heated, based on the print information, in order to record data on the sheet 2 one line at a time or a plurality of lines at a time.

After recording data onto the sheet one line at a time or a plurality of lines at a time by moving the recording head 3 during recording operation, the recording head 3 separates from the print platen 1. At the same time that the head 3 separates from the platen 1, the sheet feed mechanism 9 operates to feed the sheet by an amount corresponding to the one line of recorded data or the plurality of lines of recorded data. The sheet 2 is then transported between the supporting platen 11 and the curl straightening head 12 of the curl straightening device 10 located downstream from the print platen 1.

A description will be given of the operation of the curl straightening head 12 which moves in response to the movement of the carriage 4. Before the recording head 3 starts recording, the curl straightening head 12 is on the first rail 15 at the right side of FIG. 4, or at starting point D. At this time, the roller 12*g* at the end of the holder 12*e* of the curl straightening head 12 is separated from the supporting platen 11, so that the curl straightening head is driven in a curl straightening off driving state.

When recording is started, movement of the carriage 4 (not shown in FIG. 4) in the direction of arrow E causes counterclockwise rotation of the pinon gear 6*f*, thereby driving the belt 13. When the belt 13 is driven, the curl straightening head 12 also moves in the direction of arrow E, and separates from the first rail 15. The curl straightening head 12, kept in a curl straightening off driving state, and suspended in the air due to the tension of the belt 13, moves below the horizontal rail portion 17*b* of the third rail 17 in the direction of arrow E.

When the curl straightening head 12 moves further in the direction of arrow E, the guide roller 12*c* disposed towards the pinion gear 6*f* contacts the back side of the inclined rail portion 17*a* of the third rail 17. The curl straightening head 12 then moves downwards and towards the left along the back side of the inclined rail portion 17*a*. Further movement of the curl straightening head 12 causes the guide roller 12*c* disposed towards the pinion gear 6*f* to separate from the end 17*c* of the inclined rail 17*a*, and come into contact with the end 16*b* of the second rail 16 disposed towards the idle gear 6*g*.

When further rotation of the pinion gear 6*f* causes the two guide rollers 12*c* of the curl straightening head 12 to pass completely through the gap 17*d* due to the tension in the belt 13, the curl straightening head 12 is positioned at the first turn-around point G, such that the guide roller 12*c* disposed towards the pinion gear 6*f* is positioned on the second rail 16, and the guide roller 12*c* disposed towards the idle gear 6*g* is positioned on the inclined rail portion 17*a* of the third rail 17. The curl straightening head 12 is supported by the inclined rail 16 and the inclined rail portion 17*a*, with the roller 12*g* positioned at the upper portion thereof.

When the curl straightening head 12 is positioned at the first turn-around point G, the recording head 3, which has finished recording data onto the sheet 2, is set in a head-up state.

When the next line of the sheet 2 is to be recorded, the carriage 4 (not shown in FIG. 4) moves to the right from the turn-around point and returns back to the position it had occupied prior to recording.

When the carriage 4 moves back to the position it had occupied prior to recording, the curl straightening head 12 moves along the inclined rail portion 17*a* of the third rail 17 from the first turn-around point G, so that it moves obliquely upward and towards the right in the direction of arrow F due to the tension in the belt 13, thereby arriving at the horizontal rail portion 17*b*. At this time, the roller 12*g* at the end of the holder 12*e* of the curl straightening head 12 resiliently presses against the surface of the frictional member 11*a* of the supporting platen 11 in such a way as to be parallel thereto, causing the curl straightening head 12 to be driven in a curl straightening on driving state, so that the curl straightening head 12 moves in the direction of arrow H, while stroking the back side of the curled recorded sheet 2.

The curl straightening head 12, which has reached the end point J at the third rail 17, separates from the third rail 17, causing the roller 12*g* at the end of the holder 12*e* of the curl straightening head 12 to separate from the frictional member 11*a* of the supporting platen 11. Then, the curl straightening head 12 moves down onto the first rail 15 at the starting point D, thereby changing the driving state of the curl straightening head 12 from the curl straightening on driving state to the curl straightening off driving state.

Accordingly, the curl straightening head 12 moves from the starting point D to the first turn-around point G and back to the starting point D. This movement is repeated to straighten the curled recorded sheet.

As shown in FIG. 1, the drive means of the carriage 4, due to the rotation of the stepping motor 5, causes rotation of the pinion gear 5*a*. The rotational motion of the pinion gear 5*a* is transmitted to the belt drive gear 6*b* formed integrally with the drive gear 6*a* of the gear group 6. When the rotational motion is transmitted, the belt 7, engaging the belt drive gear 6*b*, is driven. The driving motion of the belt 7 is transmitted to the carriage 4 through the carriage coupling portion 4*a* mounted to the belt 7, causing the carriage 4 to reciprocate along the print surface 1*a* of the print platen 1.

The drive means of the curl straightening head 12 of the curl straightening device 10 transmits the rotational motion of the stepping motor 5, being the drive source used for the drive means of the carriage 4, to the intermediate 6*c* of the gear group 6 through the pinion gear 5*b*. The rotational motion of the intermediate gear 6*c* is transmitted to the drive gear 6*d*. Then, the rotational motion of the drive gear 6*d* is transmitted to the pinion gear 6*f* in the room 14*b* of the case 14 through the coupling shaft 6*e*.

Rotation of the pinion gear 6*f* causes driving of the belt 13 set over the pinion gear 6*f* and the idle gear 6*g*, causing the curl straightening head 12, mounted to the belt 13, to reciprocate along the supporting platen 11, whereby the curled sheet 2 is straightened.

Accordingly, the carriage drive means and the curl straightening device drive means are driven by the same drive source, that is by the stepping motor 5, so that two drive means can be driven simultaneously using only one drive source.

Then, the recorded sheet 2, whose curl is straightened as it moves downstream, is transported by the sheet discharge mechanism 18 disposed downstream from the curl straightening device 10, and nipped between the sheet discharge roller 18*a* and the sheet discharge guide 18*b* of the sheet discharge mechanism 18.

The recorded sheet 2 is reliably discharged out the printer P as a result of the rotation of the sheet discharge roller 18*a*. The rotational speeds of the sheet feed roller 9*a* and the sheet feed roller 18*a* are adjusted such that the speed at which the sheet 2 is transported at the sheet feed mechanism 9 is the same as the speed at which the sheet 2 is discharged out the printer P from the sheet discharge mechanism 18.

A curled sheet, curled by the recording operation of, for example, the recording head 3, can be straightened by driving the aforementioned curl straightening head 12 in a curl straightening on driving state. However, when sheets that are curled, such as overhead projector sheets, are stroked along their surfaces by the roller 12*g* supported by the holder 12*e*, making the curl straightening head 12 resiliently press against the overhead projector sheet may scratch or deform the sheet.

To overcome this problem, when the printer P of the present invention is used for recording on a sheet (such as an overhead projector sheet) that are not curled, the curl straightening head 12 of FIG. 4 moves, with the movement of the carriage 4, in the direction of arrow E from the starting point D. The curl straightening head 12, moving in the direction of arrow E, is kept in a curl straightening off driving state. After recording by the recording head 3, the curl straightening head 12, which has passed through the gap 17 and arrived at the first turn-around point G, does not move in the reverse direction. Instead, the curl straightening 12 is moved along the tilted second rail 16 until it reaches the end 16*a* of the second rail 16. Here, the supporting plate 11, disposed above the second rail 16, does not extend to the point above the end 16*a* of the second rail 16. Thus, the end of the holder 12*e* of the curl straightening head 12 never comes into contact with the supporting platen 11.

The guide roller 12*c* disposed towards the pinion gear 6*f* separates from the end 16*a* of the second rail 16. Then, the tension in the belt 13 causes the guide roller 12*c* disposed towards the idle gear 6*g* to separate from the end 16*a* of the second rail 16, causing the curl straightening device 12 to move downwards in the direction of arrow K.

Then, the curl straightening head 12 gets suspended at the second turn-around point L by the tension in the belt 13. From the second turn-around point L, the carriage 4 (not shown in FIG. 4) moves in the reverse direction. In response to this movement of the carriage 4 in the reverse direction, the curl straightening head 12 also moves in the reverse direction, as indicated by arrow M.

When the curl straightening head 12 moves in the direction of arrow M (shown in FIG. 4), causing the guide rollers 12*c* to come into contact with the back side of the second rail 16, the head 12, due to the tension in the belt 13, passes past the end 16*b*, while moving obliquely downward along the back side of the second rail 16. Then, the curl straightening head 12 moves in the direction of arrow N. While being driven in the curl straightening off driving state, the head 12 returns back onto the first rail 15 to the starting point D.

Accordingly, when, for example, an overhead projector sheet which does not require curl straightening is used, the curl straightening head 12 can always be driven in a curl straightening off driving state by controlling the amount of movement of the carriage 4, such that the turn-around point of the curl straightening head 12 is changed from the first turn-around point G to the second turn-around point L.

Accordingly, in the printer of the present invention, the curl straightening head 12 moves vertically to either resiliently press against or separate from the supporting platen 11. A selecting means is used to select either one of resiliently pressing the head 12 against or separating it from the supporting platen 11. The selecting means is composed of a cam mechanism which is a combination the first rail 15, the second rail 16, and the third rail 17, with the rails being composed of a plurality of rail-shaped protrusions.

In the foregoing description, the printer P of the present invention was described as having a roller 12*g* rotatably and separately provided at an end of the holder 12*e* of the curl straightening head 12. However, in another embodiment, the holder 12*e* may be formed from a hard metal material, and have a triangular top end which, for example, has a chrome-plated surface to reduce friction.

When the curl straightening head 12, being driven in the curl straightening off driving state, is moving in the direction of arrow E of FIG. 4, the head 12 is suspended due to the tension in the belt 13. However, in another embodiment, the first rail 15 may be extended to the vicinity of the second rail 16 so that the guide rollers 12*c* of the curl straightening head 12 are supported from below.

Although in the foregoing description the printer of the present invention was described by taking a thermal transfer printer as an example, an inkjet printer or any other printer may also be used.

According to the printer of the present invention, the sheet feed mechanism, the carriage, the curl straightening device, and the sheet discharge mechanism are successively disposed from the upstream side to the downstream side in the sheet feed direction, so that the recorded sheet can be reliably discharged out the printer by the sheet discharge mechanism. Thus, the printer is one allowing easy handling of sheets.

In addition, according to the printer of the present invention, the carriage drive means and the curl straightening drive means are driven by the same drive source, so that only one drive source is used to drive two drive means. Thus, the printer is a low-cost printer.

Further, according to the printer of the present invention, the holder of the curl straightening head moves freely while it resiliently presses against the supporting platen due to the action of the resilient member, so that sheets of different thicknesses can be made to resiliently press against the end of the holder with a uniform pressure due to the action of the resilient member. Thus, the printer allows reliable straightening of curled sheets of, for example, different thicknesses.

Still further, according to the printer of the present invention, the curl straightening head of the curl straightening device moves vertically to either resiliently press against or separate from the supporting platen. The selecting means is used to select either one of resiliently pressing the head against or separating it from the supporting platen by controlling the amount of movement of the carriage having the recording head mounted thereto. This allows the driving state of the head to be changed by changing the range of movement of the carriage. Thus, the printer is one allowing easy switching of the driving state to the curl straightening off driving state, when a sheet does not require straightening.

Still further, according to the printer of the present invention, the selecting means is composed of a cam mechanism, allowing the curl straightening head to move up and down in the vertical direction. This allows the end of the holder of the curl straightening head to resiliently press against the frictional member of the supporting platen in such a way as to be parallel thereto at all times. Thus, the printer is one allowing even more reliable curl straightening.

What is claimed is:

1. A printer comprising at least:

a carriage having a recording head mounted thereto, said recording head being used for recording onto a sheet;

a curl straightening device including a supporting platen and a curl straightening head, said supporting platen being used for supporting a recorded sheet, and said curl straightening head being used for straightening a curled sheet, said curl straightening head having a base with a resilient member provided thereat, and a holder supported by said resilient member so as to be movable in a vertical direction, wherein said curl straightening device moves freely, while said holder resiliently presses against said supporting platen by means of said resilient member; and selecting means, wherein when said curl straightening head moves vertically, said selecting means selects either one of resiliently pressing said curl straightening head against and separating said curl straightening head from said supporting platen, by controlling a range of movement of said carriage having said recording head mounted thereto.

2. A printer according to claim 1, wherein said selecting means, for selecting either one of resiliently pressing said curl straightening head against and separating said curl straightening head from said supporting platen when said curl straightening head moves vertically, is composed of a cam mechanism.

3. A printer according to claim 2, wherein said cam mechanism is composed of a combination of a plurality of rail-shaped protrusions.

* * * * *